United States Patent [19]

Marshell

[11] Patent Number: 4,590,345

[45] Date of Patent: May 20, 1986

[54] LIGHT SWITCH ADAPTER FOR TODDLERS

[76] Inventor: Edward L. Marshell, 5317 Meadow Wood Ave., Lakewood, Calif. 90712

[21] Appl. No.: 643,796

[22] Filed: Aug. 24, 1984

Related U.S. Application Data

[63] Continuation-in-part of Ser. No. 584,917, Feb. 29, 1984, abandoned.

[51] Int. Cl.[4] ..... H01H 3/20; H01H 9/20

[52] U.S. Cl. ..... 200/331; 200/43.16; 200/321

[58] Field of Search ..... 200/330–332, 200/318, 321, 322, 327, 328, 334, 42 R, 42 T, 42 A, 43.01, 43.11, 43.16; 74/503

[56] References Cited

U.S. PATENT DOCUMENTS

| | | | |
|---|---|---|---|
| 2,354,224 | 7/1944 | Stein | 200/304 |
| 2,493,581 | 1/1950 | Hood | 74/503 |
| 2,668,456 | 2/1954 | Meistrell | 74/503 |
| 2,775,674 | 12/1956 | Meder | 200/331 |
| 3,004,128 | 10/1961 | Mikolajeski | 200/331 |
| 3,839,615 | 10/1974 | Bradford | 200/331 |
| 3,892,935 | 1/1975 | Patterson | 200/331 |
| 4,079,214 | 3/1978 | Castonguay et al. | 200/42 A |
| 4,295,026 | 10/1981 | Williams et al. | 200/331 |
| 4,468,544 | 8/1984 | Wainess et al. | 200/42 R |
| 4,504,707 | 3/1985 | Ochiai | 200/42 R |

*Primary Examiner*—Stephen Marcus
*Assistant Examiner*—Ernest G. Cusick
*Attorney, Agent, or Firm*—Harvey B. Jacobson

[57] ABSTRACT

An adapter for a wall-mounted light switch enabling the switch to be operated by a toddler not otherwise able to reach the switch comprises a replacement switch cover plate which has an opening for the switch and an elongate slot which receives a switch operating rod with the rod having an opening receiving the switch and the rod extending from below the replacement cover plate to a level where it can be reached by a toddler to operate the switch. The rod and replacement cover plate may be molded in plastic and the adapter may be easily installed by inserting the rod in the slot in the cover plate and attaching the assembled rod and cover plate to a switch with a screw or screws. The replacement cover plate may have a decorative, child-pleasing appearance, and may include a locking slide which can be manipulated by an adult to prevent a child from moving the operating rod.

16 Claims, 12 Drawing Figures

FIG. 9
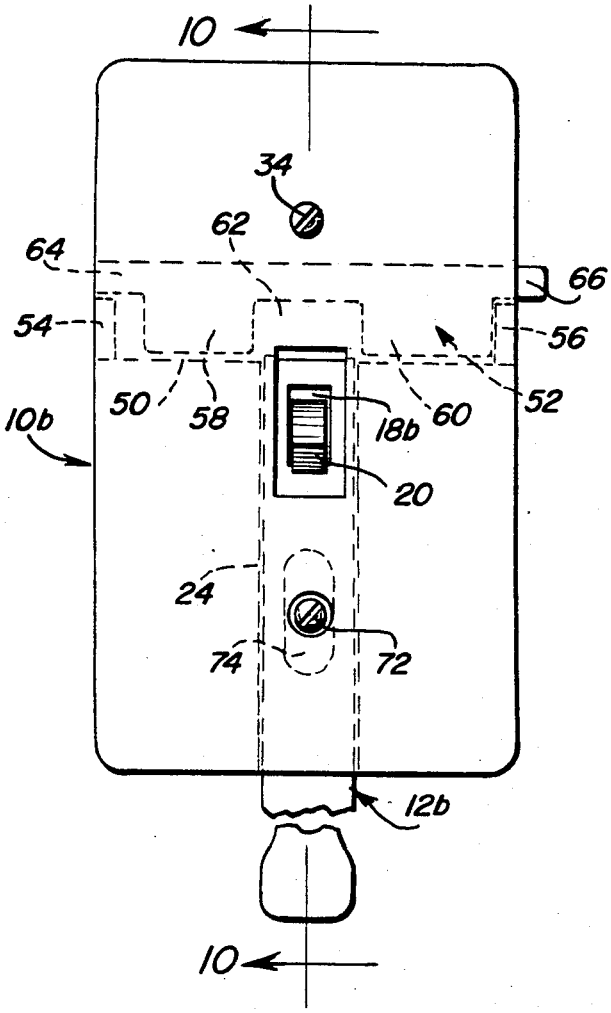
FIG. 10
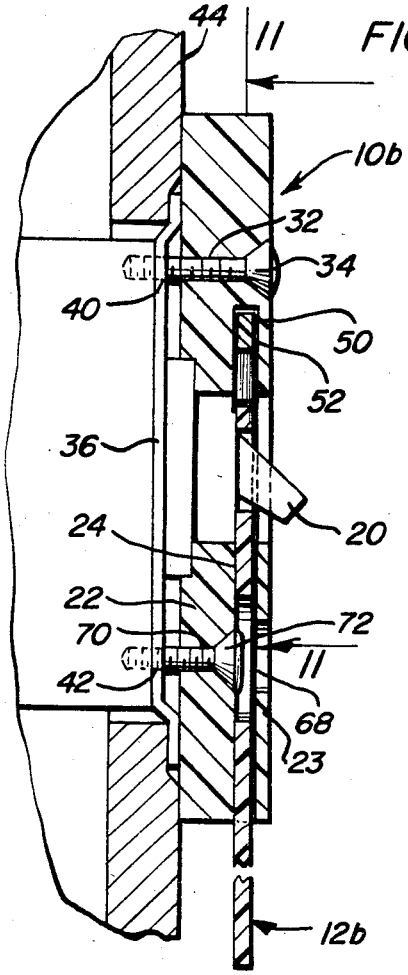
FIG. 11
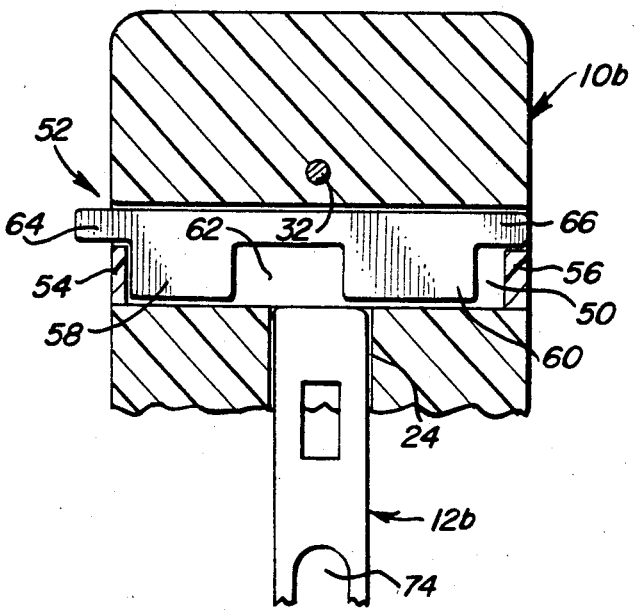
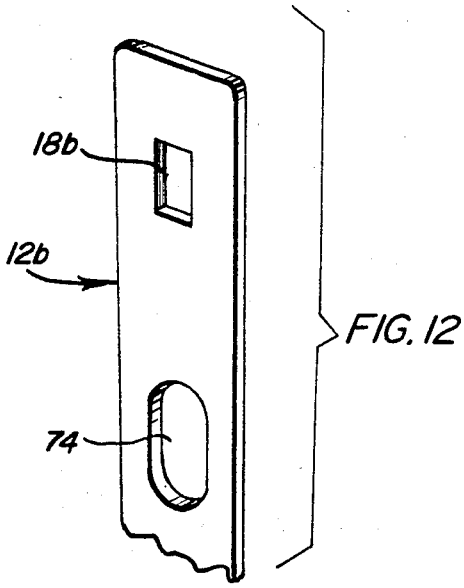
FIG. 12

LIGHT SWITCH ADAPTER FOR TODDLERS

BACKGROUND OF THE INVENTION

This application is a continuation-in-part of application Ser. No. 584,917, filed Feb. 29, 1984 now abandoned.

The invention relates to apparatus for attachment to wall-mounted toggle switches, generally light switches, which allows such switches to be operated by toddlers who would otherwise not be tall enough to reach a switch. Accordingly, the invention provides an adapter for attachment to a wall-mounted switch which includes an operating rod adapted to extend downwardly from the switch to a level at which it can be manipulated by a toddler.

STATEMENT OF THE PRIOR ART

Applicant is aware of the following U.S. patents pertaining to light switch adapters and the like. U.S. Pat. Nos:

2,493,581; 2,775,674; 3,004,128; 3,839,615; 3,892,935.

While the above patents show different forms of light switch adapters with downwardly extending operating means, the structures tend to be somewhat complex in design and/or obtrusive in their projection from a wall surface. The present invention has as an object the provision of an adapter for wall switches which is of simplified form, employing a minimum number of parts, which may be economically manufactured by readily available means, which is simple to install, and unobtrusive in use.

SUMMARY OF THE INVENTION

The invention provides, at least in one embodiment thereof, an adapter for a wall-mounted toggle switch for enabling the switch to be operated by a toddler, the adapter comprising an adapter cover plate forming a replacement for the existing switch cover plate, the adapter cover plate having an elongate internal slot extending from a bottom edge of the adapter cover plate at least part way up the cover plate, an elongate operating rod having an upper portion slidingly received in the slot for guided lengthwise movement in the slot, aligned openings in a rear wall of the adapter cover plate, an upper end of the operating rod, and a front wall of the cover plate, the opening in the rear wall of the cover plate being adapted to fit around the switch boss with the switch projecting through the openings in the operating rod and front wall of the cover plate, and a further opening formed through the adapter cover plate above the slot to receive a screw for attaching the adapter cover plate to a screw hole of the switch mounting plate in a manner securing the rod on the switch with the lower part of the rod extending below the cover plate and with the cover plate being laterally stabilized by the interfitting of said opening in the rear wall thereof around the switch boss.

Adapters in accordance with the invention may thus comprise a minimum of parts, notably an operating rod, an adapter cover plate, and a single screw, and the rod and adapter cover plate may be readily manufactured by molding each of these in plastic, for example. The adapter may be easily installed, simply by removing the existing cover plate from a wall switch, inserting the operating rod in the slot of the adapter cover plate, suspending the assembled rod and cover plate from the switch, and securing the assembly in place with a single screw. The construction of the adapter cover plate and operating rod allows for flush mounting against the wall to provide an unobtrusive construction, and the cover plate may be molded in a diversity of attractive designs and/or include personalized surface embellishments of a child-pleasing appearance.

The invention further provides a light switch adaptor for toddlers comprising a replacement switch cover plate, a switch operating rod associated with the cover plate for projecting to a level below the switch where it can be moved up and down by an infant to operate the switch, and a locking slide associated with the cover plate for operation by an adult selectively to prevent an infant moving the rod up and down as aforesaid.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 9 is a view similar to FIGS. 2 and 8 showing another form of adaptor.

FIG. 10 is a sectional view on line 10—10 of FIG. 9.

FIG. 11 is a sectional view on line 11—11 of FIG. 10.

FIG. 12 is an enlarged perspective view of part of the operating rod used in the adapter shown in FIGS. 9–11.

DESCRIPTION OF THE PREFERRED EMBODIMENTS

Figure 1:
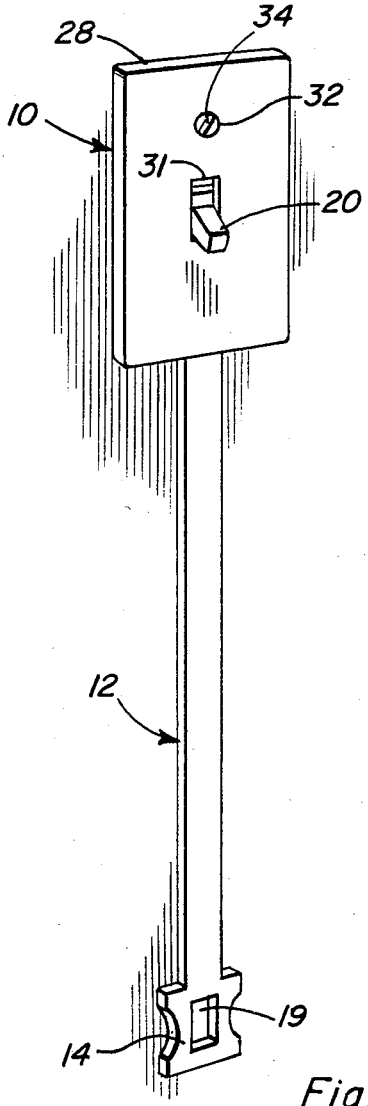
FIG. 1 is a perspective view of a wall-mounted light switch equipped with an adapter in accordance with the invention enabling the switch to be operated by a toddler.
Figure 2:
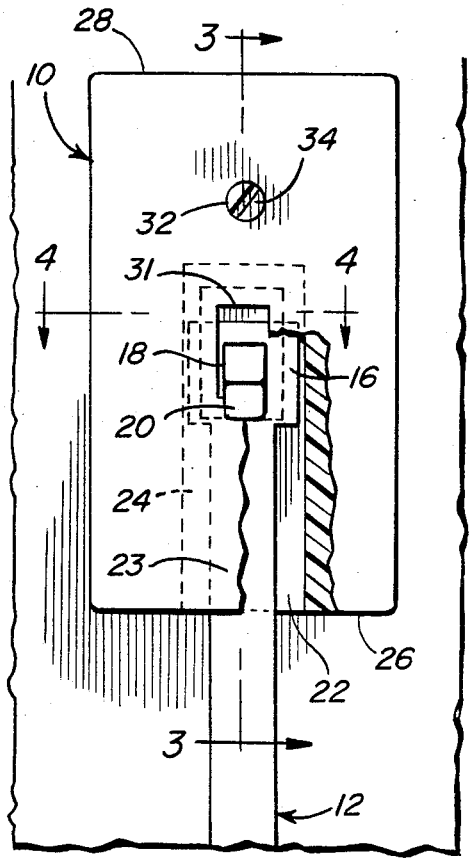
FIG. 2 is an enlarged front view, part broken away, of the adapter-equipped switch.
Figure 3:
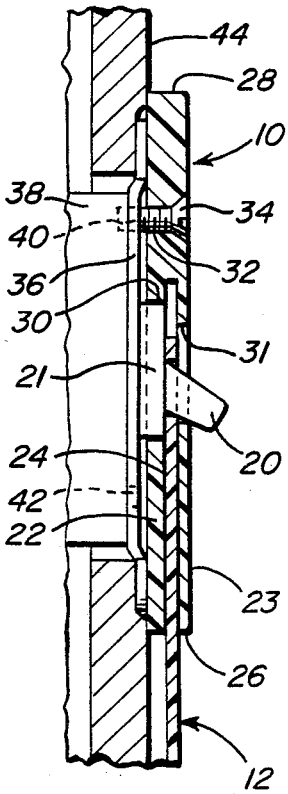
FIG. 3 is a sectional view on line 3—3 of FIG. 2.
Figure 4:
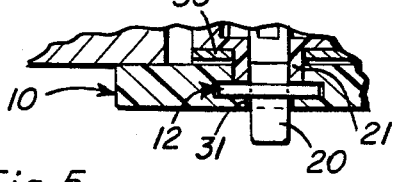
FIG. 4 is a sectional view on line 4—4 of FIG. 2.
Figure 5:
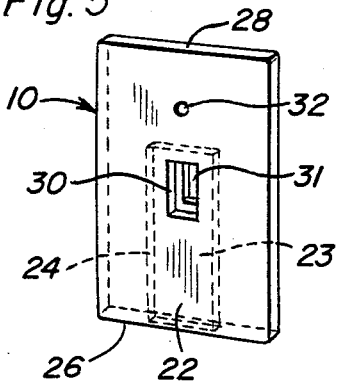
FIG. 5 is a perspective view from the rear of the adapter cover plate.

FIGS. 1 to 6 of the drawings illustrate a first preferred form of adapter for a wall-mounted light switch enabling the switch to be operated by a toddler, and comprising an adapter cover plate 10 (FIG. 5) and an operating rod 12 (FIG. 6) each of which may conveniently be a plastic molding.

Operating rod 12 may be about 8 inches to 12 inches in length with a thickness of about 1/16 inch. The rod may have a handle portion 14 at its lower end and a head 16 at its upper end formed with a rectangular opening 18 for hooking the rod over and suspending it from a wall-mounted light switch 20, as will be described.

Adapter cover pate 10 may have outer dimensions substantially conforming to those of a standard light switch cover plate, and a thickness of about 5/16 inch. The cover plate (FIG. 5) is formed with an internal elongate slot 24 extending from the lower edge 26 of the cover plate part way up toward the upper edge 28. The depth of the slot is sufficient to accommodate the thickness of rod 12 (e.g. the slot depth may be about 0.09 inch) and its width conforms substantially to the width of head 16 so as to form a guideway for the rod. The slot thereby defines a cover plate rear wall 22 and a front wall 23. Cover plate 10 is further provided with a first rectangular opening 30 in rear wall 22, opening 30 communicating with the upper end of slot 24, and a second somewhat smaller rectangular opening 31 in front wall 23 aligned with opening 30. A further opening 32 is formed through the cover plate above the slot to receive an attachment screw 34 forming a third element of the adapter. Screw 34 may, for example, be a 6–32×⅝" screw.

The adapter is suitable for attachment to a standard wall-mounted switch fitting wherein switch toggle 20 projecting from a rectangular boss 21 is carried on a standard metal mounting plate 36 (FIG. 3) in a wall receptacle 38. A standard mounting plate 36 of this nature generally has upper and lower screw holes 40, 42 to which a standard cover plate (not shown) is secured. To install the adapter, it is merely necessary to remove the standard cover plate from the fitting, insert rod 12 into slot 24, suspend the assembly on switch 20, through suitable alignment of openings 30, 18 and 31, and secure the adapter cover plate 10 in position using only the single screw 34 threaded into upper screw hole 40 of the mounting plate 36. The opening 30 is dimensioned to fit snugly over switch boss 21 so as to laterally stabilize the assembly though only a single secured screw is used.

The design of the adapter allows the cover plate 10 to fit flush against the wall 44 (FIG. 3) with operating rod 12 extending downwardly is close proximity to the wall to a position where it can be reached by a toddler to operate the switch by raising and lowering handle portion 14 of the rod. The switch can also be operated directly in the usual manner.

Figure 6:
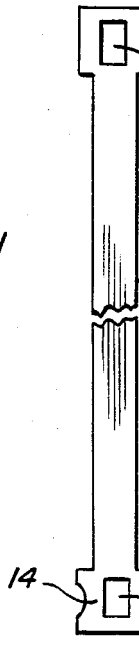
FIG. 6 is an elevational view of the adapter operating rod.
Figure 7:
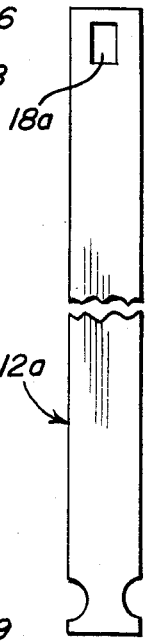
FIG. 7 is an elevational view of another form of operating rod.
Figure 8:
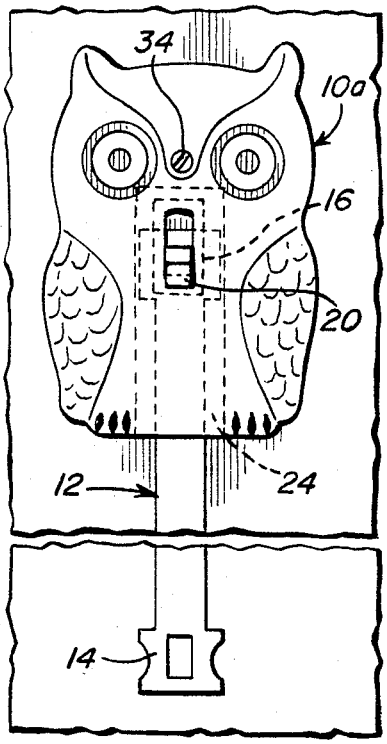
FIG. 8 is a view similar to FIG. 2 showing a modified form of an adapter cover plate.

As shown in FIG. 6, the operating rod may have a further opening 19 at the handle end which may be of a different size opening 18 for use with different size switches and, as shown in FIG. 7, the rod **12*a* may have a uniform width throughout its length. The modified fitting illustrated in FIG. 8 is of similar construction to that described above except that cover plate 10*a* is molded to simulate an owl. Clearly the cover plate can be formed in other decorative child-pleasing designs. In a further modification (not illustrated) rear wall 22 of the cover plate is omitted and stabilizing tabs are provided behind slot 24** to embrace opposite sides of the switch boss.

FIGS. 9–12 show yet another form of adaptor in accordance with the invention which incorporates a locking device operable by an adult selectively to prevent an infant from actuating the light switch. In this embodiment, adaptor cover plate **10*b* is of like form to those of the previous embodiments insofar as the provision of slot 24 and operating rod 12*b* are concerned. In this case, however, the cover plate includes a transverse slot 50 at the top of slot 24 with a locking slide 52 received in slot 50 (after insertion of slide 52 the ends of the slot may be closed by glued-in or like inserts 54, 56 or the like). Slide 52 has a pair of lobes 58, 60 with a gap 62 therebetween and operating tabs 64, 66 at its ends, one or other of which projects from one or other side of the cover plate dependent on the position of the slide. When the slide is in its right-hand position (FIG. 9), gap 62 is centralized over the top of operating rod 12*b* allowing an infact to raise the rod to actuate switch 20 as in the previous embodiments. When, however, slide 52 is shifted to its left-hand position by pressing tab 66 inwardly (FIG. 11), lobe 60 forms a locking shoulder for the top of rod 12*b*** preventing an infant from raising the rod to actuate the switch.

Additionally, in the embodiment shown in FIGS. 9–12, cover plate **10*b* is provided with openings 68, 70 respectively, in the front and rear walls 23, 22 for a second mounting screw 72 fitting in the lower screw hole 42 of mounting plate 36. The provision of the seond screw 72 is to meet the requirements of certain jurisdictions which require the use of two such screws. Opening 68 is large enough to permit passage of the screw head, and rod 12*b* is likewise provided with an elongate slot 74** providing clearace for the screw head as the operating rod is raised and lowered.

It will be appreciated from the foregoing that adapters in accordance with the invention are of simplified manufacture and installation, involving a minimum of parts and installation procedures. When installed, the flush mounting facility of the adapter provides minimum protrusion compared with a standard switch cover plate. The device is reliable in operation and the design of the rod and cover plate wherein the cover plate slot forms a guideway for the rod allows for close working tolerances between these parts limiting side-to-side movement of the rod and minimizing breakages. Additionally, if required (e.g. when a toddler grows sufficiently to reach a standard light switch) the rod may be removed from the adapter and the cover plate used on its own.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adapter for a wall-mounted switch having a switch boss and a switch toggle projecting from the boss, the adapter enabling the switch to be operated by a toddler otherwise unable to reach the switch, the adapter comprising an adapter cover plate forming a replacement for an existing switch cover plate, the adapter cover plate having an elongate internal slot extending from a bottom edge of the adapter cover plate at least part way up the cover plate, an elongate operating rod having an upper portion slidingly received in the slot for guided lengthwise movement in the slot, aligned openings in a rear wall of the adapter plate, an upper end of the operating rod and a front wall of the adapter cover plate, the opening in the rear wall being adapted to fit around the switch boss with the toggle projecting through the openings in the operating rod and the front wall of the cover plate, and a further opening formed through the adapter cover plate above the first and second openings to receive a screw for attaching the cover plate to a switch mounting plate through a screw hole in the mounting plate in a manner securing the rod on the switch with the lower part of the rod extending below the adapter cover plate to a level where it may be reached by a toddler, wherein the adapter cover plate includes a transverse slot intersecting said elongate slot and a stop slide selectively movable in the transverse slot between first and second positions respectively, blocking the operating rod for movement by a toddler to actuate the switch and freeing the operating rod for such movement.

2. The invention of claim 1 wherein the width of the slot is related to the width of said upper portion of the rod to form a guideway for the rod minimizing side-to-side movement of the rod during lengthwise movement thereof in the slot operating the switch.

3. The invention of claim 2 wherein said upper portion of the rod comprises an enlarged head.

4. The invention of claim 3 wherein the rod has an enlarged handle portion at its opposite end.

5. The invention of claim 1 wherein the slot in the adapter cover plate terminates short of the further opening formed therethrough.

6. The invention of claim 1 wherein the rod and the adapter cover plate each comprises a plastic molding.

7. The invention of claim 6 wherein the adapter cover plate is molded to a decorative form.

8. The invention of claim 1 wherein the transverse slot is at the top of the elongate slot, and the stop slide has a lobe providing a blocking projection for the top of the operating rod when the slide is in the first position and a gap adjacent said lobe providing clearance for the top of the operating rod when the slide is in the second position.

9. A light switch adapter for toddlers comprising a replacement switch cover plate, a switch operating rod associated with the cover plate for projecting to a level below the switch where it can be moved up and down to operate the switch by a toddler otherwise unable to reach the switch, and locking means associated with the cover plate for operation by an adult selectively to prevent a toddler from moving the rod to actuate the switch, wherein the locking means comprises a locking slide mounted in the cover plate for transverse movement into and out of blocking engagement with the operating rod and wherein the operating rod and locking slide are mounted in the cover plate for movement in a common plane.

10. The invention of claim 9 wherein, the locking slide is located above the operating rod, the locking slide having a lobe for movement into blocking position with the top of the operating rod and a space adjacent the lobe allowing upward movement of the rod when the lobe is moved out of blocking engagement with the rod.

11. The invention of claim 9 wherein the operating rod and locking slide are located respectively in coplanar longitudinal and transverse slots formed in the cover plate, the longitudinal slot defining front and rear cover plate walls with openings for receipt of the switch.

12. The invention of claim 9 wherein the slide has operating tabs at the opposite ends thereof which project alternately from opposite sides of the cover plate when the slide is moved into and out of blocking engagement with the operating rod respectively.

13. A replacement cover plate structure for replacing a standard cover plate of a wall-mounted light switch, the switch having a switch boss and a switch toggle projecting from the boss, the replacement cover plate structure having front and rear walls defining an elongate slot therebetween extending from a bottom edge of the cover plate structure at least partially up the length thereof for receipt of a switch operating rod, aligned openings in the front and rear walls substantially centrally located on the cover plate, the opening in the rear wall for surrounding the switch boss and the opening in the front wall for the switch toggle to pass through, and a screw opening in the cover plate structure above the aligned openings for receipt of a mounting screw for attaching the cover plate structure to a switch mounting plate, wherein the cover plate structure includes a transverse slot intersecting the elongate slot, and a locking slide movable in the transverse slot for selective positioning into and out of blocking engagement with an operating rod received in the elongate slot.

14. The invention of claim 13 wherein the cover plate includes further screw openings in the front and rear walls below the aligned openings for receipt of a second mounting screw, the further opening in the front wall being larger than the further opening in the rear wall to allow passage of the screw head.

15. The invention of claim 13 wherein the opening in the rear wall of the cover plate structure is for embracing the switch boss forming lateral stabilizing means for the cover plate.

16. An adapter for a wall-mounted switch having a switch boss and a switch toggle projecting from the boss, the adapter enabling the switch to be operated by a toddler otherwise unable to reach the switch, the adapter comprising an adapter cover plate forming a replacement for an existing switch cover plate, the adapter cover plate having an elongate internal slot extending from a bottom edge of the adapter cover plate at least part way up the cover plate, an elongate operating rod having an upper portion slidingly received in the slot for guided lengthwise movement in the slot, aligned openings in a rear wall of the adapter plate, an upper end of the operating rod and a front wall of the adapter cover plate, the opening in the rear wall being adapted to fit around the switch boss with the toggle projecting through the openings in the operating rod and the front wall of the cover plate, and a further opening formed through the adapter cover plate above the first and second openings to receive a screw for attaching the cover plate to a switch mounting plate through a screw hole in the mounting plate in a manner securing the rod on the switch with the lower part of the rod extending below the adapter cover plate to a level where it may be reached by a toddler, wherein the adapter cover plate has a further opening through the front wall, and a further opening through the rear wall, said further openings being located below said aligned openings for receipt of a second screw for attaching the adapter cover plate to a switch mounting plate through a second screw hole in the mounting plate, the further opening through the front wall being larger than the further opening through the rear wall so as to provide passage for a screw head.

* * * * *